US006358125B2

(12) United States Patent
Kawashima et al.

(10) Patent No.: US 6,358,125 B2
(45) Date of Patent: Mar. 19, 2002

(54) POLISHING LIQUID SUPPLY APPARATUS

(75) Inventors: Kiyotaka Kawashima; Mutsumi Tanikawa; Hiroshi Shimomoto, all of Yokohama; Keiko Chono, Fujisawa, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/724,999

(22) Filed: Nov. 29, 2000

(30) Foreign Application Priority Data

Nov. 29, 1999 (JP) ..... 11-337319

(51) Int. Cl.[7] ..... B24B 7/19

(52) U.S. Cl. ..... 451/60; 451/446; 451/36; 210/96.1; 210/416.1

(58) Field of Search ..... 451/36, 60, 87, 451/88, 99, 446, 447; 210/167, 961, 416.1, 739

(56) References Cited

U.S. PATENT DOCUMENTS 4,059,929 A 11/1977 Bishop
5,478,435 A 12/1995 Murphy et al.
5,957,759 A * 9/1999 Cardenas et al. ..... 451/60
6,059,920 A 5/2000 Nojo et al.
6,106,728 A * 8/2000 Iida et al. ..... 451/60
6,159,082 A * 12/2000 Sugiyama et al. ..... 451/60 X
6,183,352 B1 * 2/2001 Kurisawa ..... 451/60 X
6,257,965 B1 * 7/2001 Kamikubo et al. ..... 451/446 X

FOREIGN PATENT DOCUMENTS

JP 07-052045 2/1995

* cited by examiner

*Primary Examiner*—Joseph J. Hail, III
*Assistant Examiner*—Anthony Ojini
(74) *Attorney, Agent, or Firm*—Wenderoth, Lind & Ponack, L.L.P.

(57) ABSTRACT

A polishing liquid supply apparatus supplies a polishing liquid to a polishing unit. The polishing liquid supply apparatus includes a supply tank for storing a polishing liquid having a predetermined concentration, and a polishing liquid pipe for delivering the polishing liquid from the supply tank to a polishing liquid supply nozzle in the polishing unit. The polishing liquid supply apparatus further includes an additive tank for storing an additive having a predetermined concentration, and an additive supply pipe for adding the additive supplied from the additive tank to the polishing liquid stored in the supply tank or to the polishing liquid in a polishing liquid passage including the polishing liquid pipe.

21 Claims, 5 Drawing Sheets

POLISHING LIQUID SUPPLY APPARATUS

BACKGROUND OF THE INVENTION

1. Field of the Invention

The present invention relates to a polishing liquid supply apparatus for use in a polishing unit for polishing a surface of a workpiece such as a semiconductor wafer, and more particularly to a polishing liquid supply apparatus which is capable of supplying a polishing liquid that stably contains an additive.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

FIG. 5 of the accompanying drawings shows a conventional polishing unit. As shown in FIG. 5, the conventional polishing unit comprises a turntable 142 with a polishing cloth 140 attached to an upper surface thereof, a top ring 144 for holding a semiconductor wafer W which is a workpiece to be polished while rotating the semiconductor wafer W and pressing the semiconductor wafer W against the polishing cloth 140, and a polishing liquid supply nozzle 146 for supplying a polishing liquid Q to the polishing cloth 140. The top ring 144 is connected to a top ring drive shaft 148, and vertically movably supported by an air cylinder (not shown).

The top ring 144 supports on its lower surface an elastic pad 150 made of polyurethane or the like. The semiconductor wafer W is held on the top ring 144 in intimate contact with the elastic pad 150. The top ring 144 also has a cylindrical guide ring 152 mounted on a lower outer circumferential surface thereof for preventing the semiconductor wafer W from being dislodged from the lower surface of the top ring 144 while the semiconductor wafer W is being polished. The guide ring 152 is fixed to the top ring 144, and has a lower end projecting downwardly beyond the lower holding surface of the top ring 144 to define a recess between the lower holding surface of the top ring 144 and the projecting lower end of the guide ring 152 for holding the semiconductor wafer W therein.

With the above structure, the semiconductor wafer W is held against the lower surface of the elastic pad 150 on the lower surface of the top ring 144, and pressed against the polishing cloth 140 by the top ring 144. The turntable 142 and the top ring 144 are rotated about their own axes to move the polishing cloth 140 and the semiconductor wafer W relatively to each other for thereby polishing the semiconductor wafer W. At this time, the polishing liquid Q is supplied from the polishing liquid supply nozzle 146 to the polishing cloth 140. The polishing liquid Q comprises fine abrasive particles suspended in, for example, an alkaline solution. Therefore, the semiconductor wafer W is polished by a composite action of a chemical action of the alkaline solution and a mechanical action of the fine abrasive particles. Such a polishing process is referred to as chemical mechanical polishing (CMP).

In order to polish the semiconductor wafer W satisfactorily by the polishing apparatus, it is necessary that the polishing liquid having a constant concentration be supplied stably at a constant rate to the polishing unit. The polishing liquid is supplied from a polishing liquid supply system which includes a raw material tank for storing a raw material that comprises a mixture of KOH, $NH_4OH$, or the like, and powder silica, and an adjustment tank for adjusting the raw material supplied from the raw material tank to a predetermined concentration by diluting the raw material with pure water or a chemical solution. The polishing liquid supply system further includes a supply tank for temporarily storing a polishing liquid adjusted by the adjustment tank and supplying the polishing liquid, and a polishing liquid supply piping system interconnecting the tanks for supplying the polishing liquid from the supply tank to the polishing liquid supply nozzle 146 in the abrasive unit.

The polishing liquid contains an additive such as an oxidizing agent for modifying or reforming the polished surface of the semiconductor wafer. Specifically, an oxidizing agent such as $H_2O_2$ (hydrogen peroxide) is added for the purpose of oxidizing a metal film of copper or tungsten that has been deposited on the semiconductor wafer. It has been customary to add the additive when the polishing liquid is produced. Thus, in the case where the additive, like oxidizing agent, added to the polishing liquid is chemically unstable, the properties of the polishing liquid tend to be changed when the polishing liquid with the additive is held in stock for a long period of time, with the result that the polishing capability of the polishing liquid becomes unstable.

If the additive is added to the polishing liquid in the polishing liquid supply system, then it has been the general practice to supply the additive, which has been diluted to a desired concentration with a solvent such as pure water in a polyethylene container or the like, from an additive supply unit to the polishing liquid supply system. Thus, the additive supply unit is relatively large in size, and needs a large installation space. In addition, because the additive is added in a small quantity to the polishing liquid in the polishing liquid supply system, the additive is required to be supplied highly accurately.

SUMMARY OF THE INVENTION

It is therefore an object of the present invention to provide a polishing liquid supply apparatus which is capable of supplying a polishing liquid that stably contains an additive to a polishing unit, and a polishing apparatus having such polishing liquid supply apparatus.

According to an aspect of the present invention, there is provided an apparatus for supplying a polishing liquid to a polishing unit for polishing a workpiece, comprising: a supply tank for storing a polishing liquid having a predetermined concentration; a polishing liquid pipe for delivering the polishing liquid from the supply tank to a polishing liquid supply nozzle in the polishing unit; an additive tank for storing an additive having a predetermined concentration; and an additive supply pipe for adding the additive supplied from the additive tank to the polishing liquid stored in the supply tank or to the polishing liquid in a polishing liquid passage including the polishing liquid pipe.

Since the additive is added to the polishing liquid at a position close to the polishing unit where the polishing liquid is used, the polishing liquid that contains the additive of stable quality at a required concentration can be supplied to the polishing unit even if the additive comprises an oxidizing agent or the like that tends to be easily degraded or decomposed due to aging. Therefore, the polishing unit can polish a workpiece stably in a high quality with the polishing liquid. The additive may comprise an oxidizing agent such as iron nitrate, an aqueous solution of hydrogen peroxide or ammonium persulfate, or material of stabilizing the distribution of particle diameters of abrasive particles in the polishing liquid.

The polishing liquid supply apparatus may further comprise an additive concentration adjusting device for adjusting the concentration of the additive. The additive concentration adjusting device may comprise an additive preparing device for mixing a raw material powder and a solvent to form the additive. Inasmuch as the additive is prepared from its raw material immediately before it is used, the additive is prevented from being degraded or decomposed due to aging.

The polishing liquid supply apparatus may further comprise an additive concentration adjusting device associated with the additive tank or the additive supply pipe, for adjusting the concentration of the additive, or an additive quantity adjusting device associated with the additive tank or the additive supply pipe, for adjusting the quantity of the additive which is added to the polishing liquid. The additive concentration adjusting device and/or the additive quantity adjusting device are effective to keep the concentration of the additive in the polishing liquid at a desired value so as to meet the required conditions.

The polishing liquid supply apparatus may further comprise a sensor associated with the polishing liquid pipe for detecting the concentration of the additive, and a controller for controlling the additive concentration adjusting device in response to an output signal from the sensor. Further, the polishing liquid supply apparatus may further comprise a sensor associated with the polishing liquid pipe for detecting the concentration of the additive, and a controller for controlling the additive quantity adjusting device in response to an output signal from the sensor.

According to another aspect of the present invention, there is provided a polishing apparatus for polishing a workpiece, comprising: a polishing unit for polishing a workpiece by holding the workpiece by a workpiece holder and pressing the workpiece against a polishing surface on a polishing table; and a polishing liquid supply apparatus for supplying a polishing liquid to the polishing unit, the polishing liquid supply apparatus comprising: a supply tank for storing a polishing liquid having a predetermined concentration; a polishing liquid pipe for delivering the polishing liquid from the supply tank to a polishing liquid supply nozzle in the polishing unit; an additive tank for storing an additive having a predetermined concentration; and an additive supply pipe for adding the additive supplied from the additive tank to the polishing liquid stored in the supply tank or to the polishing liquid in a polishing liquid passage including the polishing liquid pipe.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
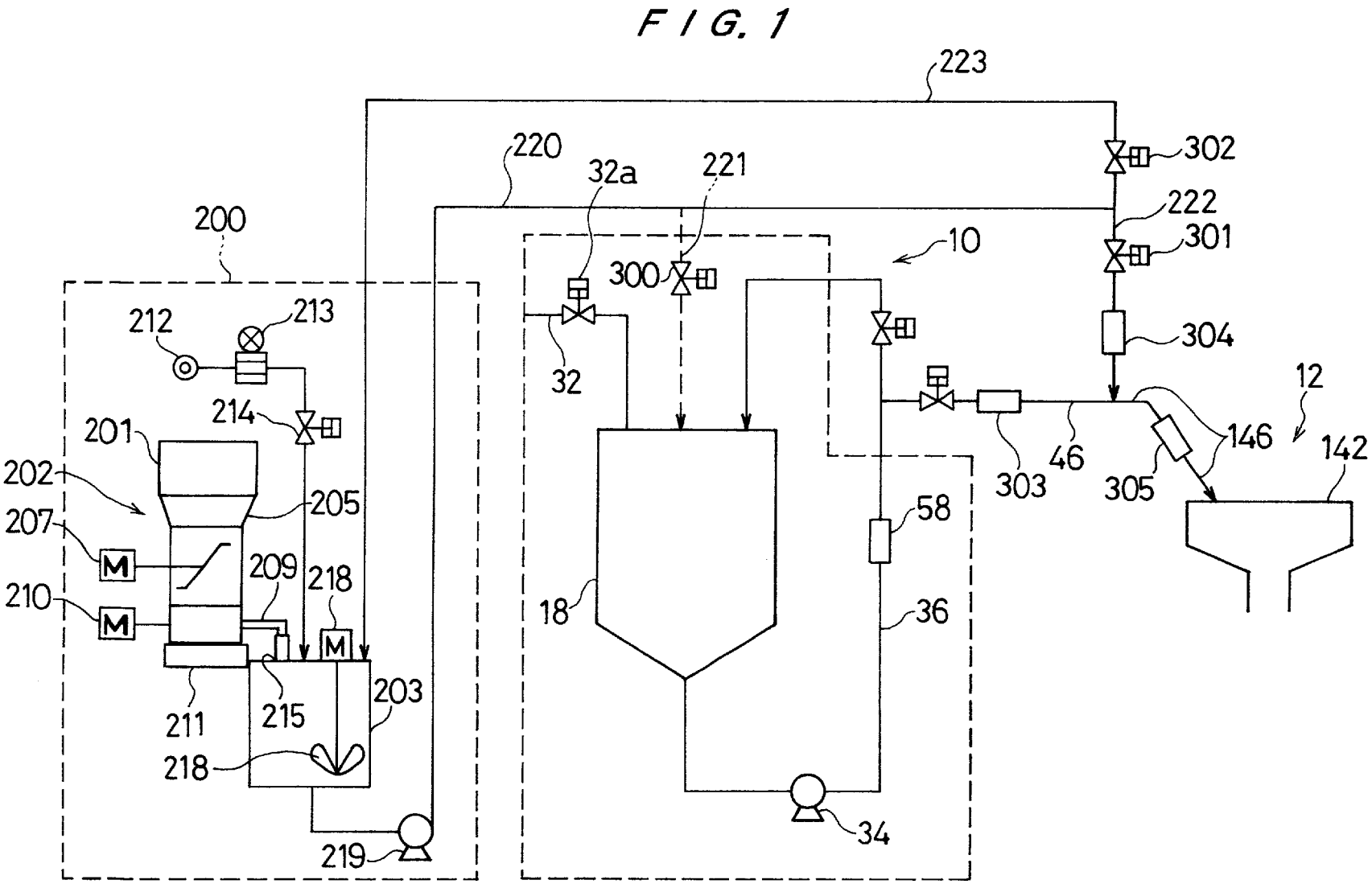
FIG. 1 is a schematic view of a polishing apparatus which incorporates a polishing liquid supply apparatus according to a first embodiment of the present invention.

Like or corresponding reference numerals denote like or corresponding parts throughout views.

A polishing apparatus which incorporates a polishing liquid supply apparatus according to a first embodiment of the present invention will be described below with reference to FIG. 1.

Figure 5:
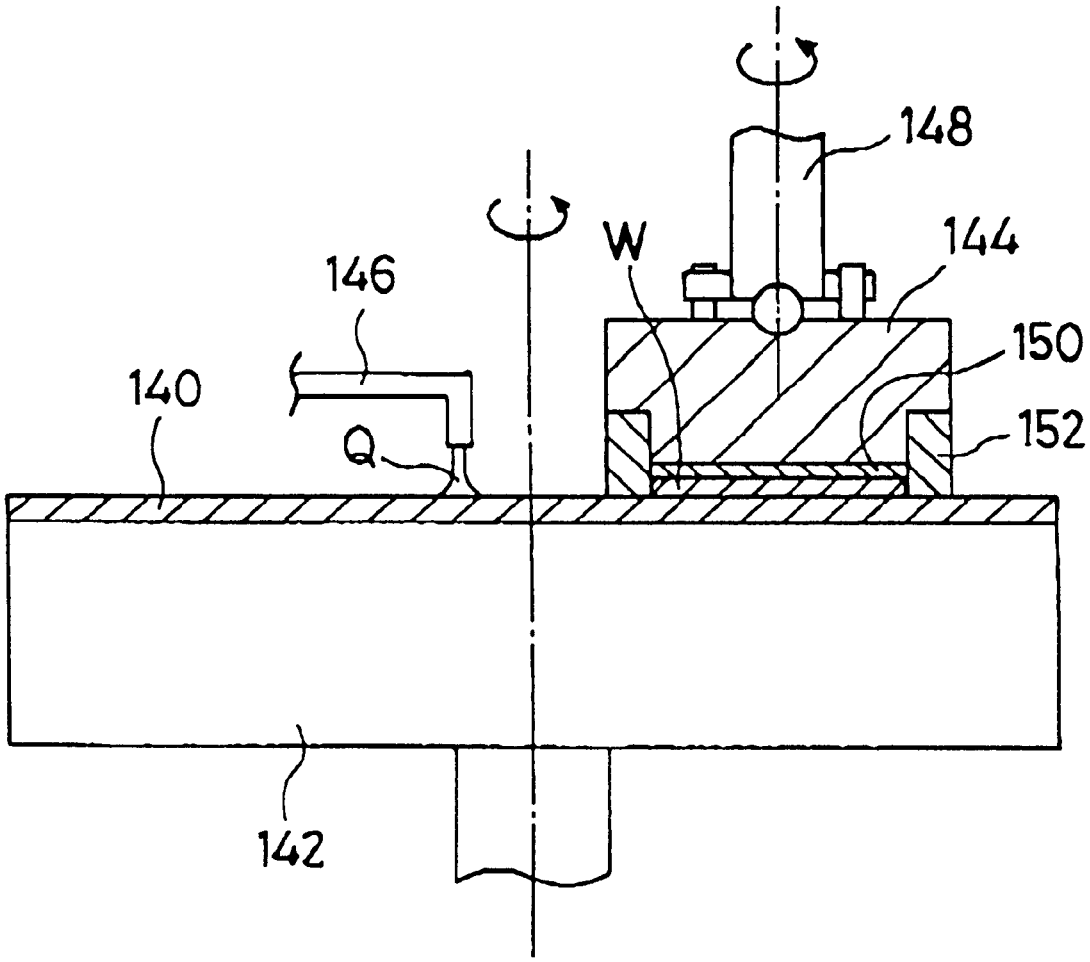
F I G. 5 (PRIOR ART)
FIG. 5 is a vertical cross-sectional view of a conventional polishing apparatus.

As shown in FIG. 1, the polishing apparatus generally comprises a polishing unit 12, a polishing liquid supply unit 10 for supplying a polishing liquid to the polishing unit 12, and an additive supply unit 200 for supplying an additive to the polishing liquid supply unit 10. The polishing unit 12 has a turntable 142 and a polishing liquid supply nozzle 146, and is of a structure identical to the conventional polishing unit shown in FIG. 5. The polishing cloth 140 on the turntable 142 constitutes a polishing surface on a polishing table.

Figure 2:
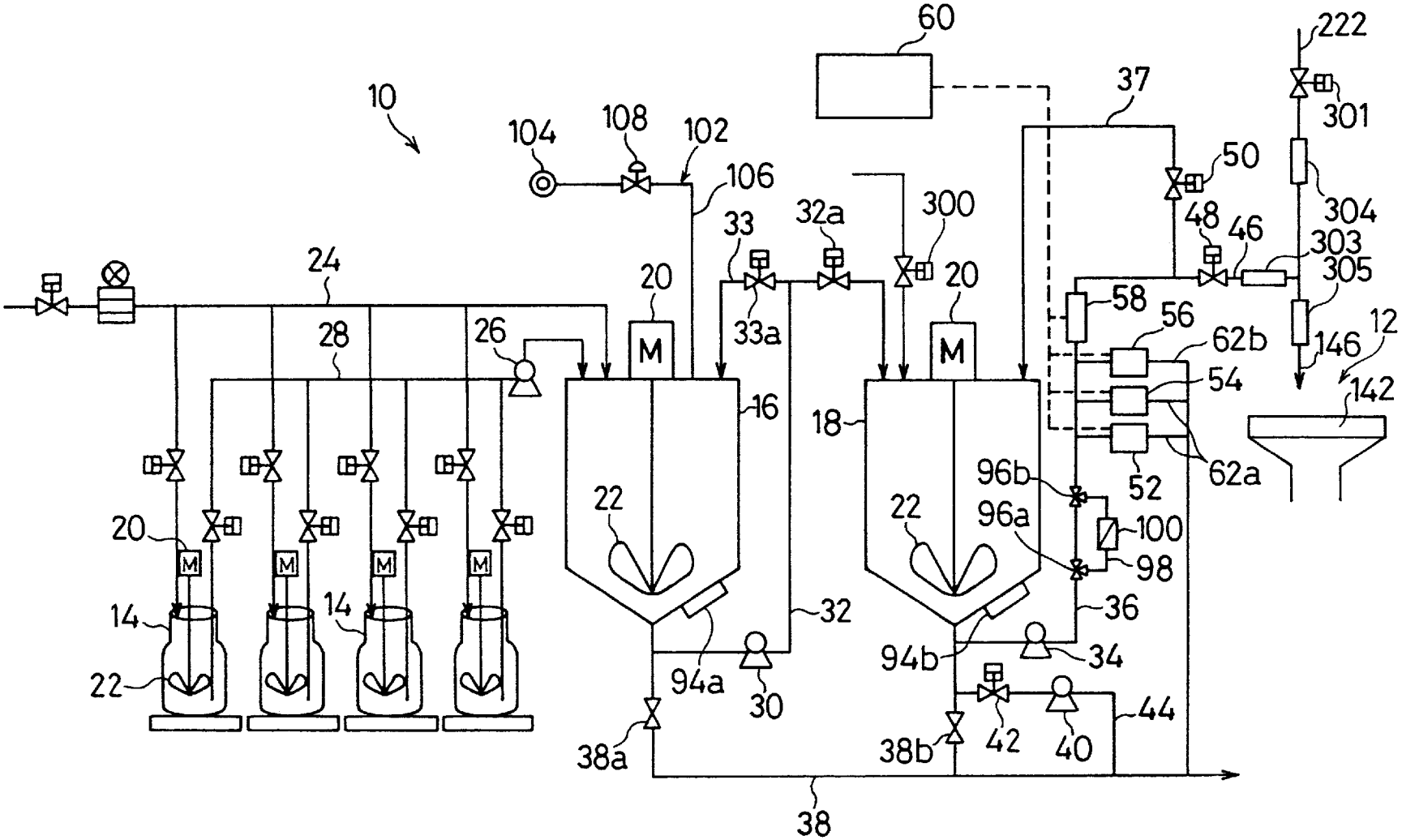
FIG. 2 is a schematic view of the polishing liquid supply apparatus shown in FIG. 1.

The polishing liquid supply unit 10, partly shown in FIG. 1, will be described in detail below with reference to FIG. 2. As shown in FIG. 2, the polishing liquid supply unit 10 includes a plurality of raw liquid tanks 14 for storing a raw polishing liquid, and an adjustment tank 16 for adjusting the raw polishing liquid supplied from the raw liquid tanks 14 to a predetermined concentration by diluting the raw polishing liquid with pure water or a chemical solution. The polishing liquid supply unit 10 further includes a supply tank 18 for temporarily storing the polishing liquid whose concentration has been adjusted by the adjustment tank 16, and supplying the polishing liquid to the polishing unit 12. Each of the tanks 14, 16 and 18 houses therein an agitator 22 that is rotated by a motor 20. A pure water line 24 is connected to the raw liquid tanks 14 and the adjustment tank 16. The raw liquid tanks 14 and the adjustment tank 16 are interconnected by a raw liquid pipe 28 having a raw liquid pump 26.

The adjustment tank 16 and the supply tank 18 are interconnected by a liquid feed pipe 32 having a liquid feed pump 30 and a shut-off valve 32*a*. The liquid feed pipe 32 is branched into a return pipe 33 which is connected to an upper end of the adjustment tank 16 via a shut-off valve 33*a*. The supply tank 18 is connected to a polishing liquid pipe 46 of the polishing unit 12 by a supply pipe 36 having a supply pump 34. The supply pipe 36 is branched into a return pipe 37 which is connected to an upper end of the supply tank 18 via a shut-off valve (circulation valve) 50.

The liquid feed pipe 32 and the supply pipe 36 are also branched respectively at positions upstream of the pumps 30, 34 and connected to a drain line 38 via respective shut-off valves 38*a*, 38*b*. The drain line 38 extending from the supply pipe 36 is shunted by a forced drain line 44 having a drain pump 40 and a drain valve 42. The polishing liquid pipe 46 connected to the downstream portion of the supply pipe 36 serves to supply the polishing liquid to the turntable 142 of the polishing unit 12. The turntable 142 constitutes a polishing table having a polishing surface thereon. The polishing liquid pipe 46 has a polishing liquid supply valve 48, and the return pipe 37 has a circulation valve 50 positioned downstream of the point where the return pipe 37 is branched from the supply pipe 36.

The supply pipe 36 is branched into extraction pipes 62*a*, 62*a* and 62*b* having an abrasive particle diameter distribution measuring device 52, a coarse particle measuring device 54, and an oxidation-reduction electrometer 56. The extraction pipes 62*a*, 62*a* and 62*b* are joined together at a position downstream of the measuring devices 52, 54 and the electrometer 56, and connected to the drain line 38. The supply pipe 36 has a solid material concentration measuring device 58 positioned downstream of the points where the extraction pipes 62*a*, 62*b* are branched from the supply pipe 36. Measured results from the measuring devices 52, 54, 58 and the electrometer 56 are inputted into a controller 60. The supply pipe 36 is shunted by a bypass line 98, with a filter 100, which is connected to the supply pipe 36 via valves 96*a*, 96*b*.

The additive supply unit 200 will be described below with reference to FIGS. 1 and 3. The additive supply unit 200 comprises a constant rate feeder 202 for receiving a raw material powder of the additive from a raw material cartridge 201 and feeding a constant rate of the raw material powder to a concentration adjustment tank 203 for being supplied with the raw material powder, and an additive supply pump 219. The raw material cartridge 201 comprises a closed container having an openable lid in its bottom, and can be placed on the upper part of the constant rate feeder 202.

The constant rate feeder 202 comprises a container placed on a weighing machine 211, and has a mount base for the raw material cartridge 201, and a hand-operated valve 204 and a hopper 205 that are positioned below the mount base. The hand-operated valve 204 serves to open the openable lid in the bottom of the raw material cartridge 201. The constant rate feeder 202 houses centrally therein an agitator 206 for agitating and compacting the supplied raw material powder, and also houses in its lower portion a screw feeder 208 for discharging the raw material powder through a powder supply pipe 209 that projects laterally from a lower side wall of the constant rate feeder 202. The agitator 206 has agitating vanes mounted on a horizontal drive shaft that is rotated by a motor 207. When rotated, the agitating vanes compact the raw material powder to a desired density and supply the compacted raw material powder to the screw feeder 208. The screw feeder 208 has an end coupled to a motor 210 by which the screw feeder 208 is rotated about its own axis for thereby feeding the compacted raw material powder into the powder supply pipe 209.

The powder supply pipe 209 has an L-shaped structure including a horizontal section which receives an outer end portion of the screw feeder 208 and a vertical section extending downwardly from an outer end of the horizontal section. The vertial section has a lower portion inserted into an opening 215 of a lid 217 of the concentration adjustment tank 203. The powder supply pipe 209 has a lower tip end connected to a moisture blocking damper 216. The moisture blocking damper 216 is opened when the raw material powder is supplied, and is closed when the raw material powder is not supplied, whereby a vapor in the concentration adjustment tank 203 is preventing from entering the powder supply pipe 209.

The concentration adjustment tank 203 is positioned below the constant rate feeder 202. A solvent supply pipe 212 is also inserted into the lid 217 of the concentration adjustment tank 203. The solvent supply pipe 212 serves to supply a solvent to the concentration adjustment tank 203. The solvent supply pipe 212 has an orifice 213 and a flow rate regulating valve 214. The concentration adjustment tank 203 houses therein an agitator 218 for mixing the raw material powder and the solvent to form an additive having uniform concentration. The agitator 218 comprises agitating vanes mounted on a vertical drive shaft extending downwardly from the lid 217, and a drive motor mounted on the lid 217 and coupled to the drive shaft. The agitator 218 may be replaced with a magnet stirrer disposed in a lower portion of the concentration adjustment tank 203.

An additive supply pipe 220 is connected to the bottom of the concentration adjustment tank 203. The additive supply pipe 220 serves to deliver the additive to a polishing liquid supply system with an additive supply pump 219. The additive supply pump 219 may comprise a diaphragm pump, a plunger pump, a tubing pump, or the like for supplying the additive at a controlled constant rate. It is desirable that the additive supply pump 219 comprises a plunger pump for supplying the additive at a highly stable rate. The polishing liquid supply system refers to a system downstream of the loop which comprises the supply tank 18, the supply pump 34, and the supply pipe 36.

The additive supply pump 219 has an outlet connected to the supply tank 18 via, the additive supply pipe 220, an additive supply pipe 221 and an air-operated valve 300 or to the supply nozzle 146 via, the additive supply pipe 220, an additive supply pipe 222 and a valve 301. The additive supply pipe 222 is branched into a return pipe 223 which returns the additive to the concentration adjustment tank 203 when the polishing unit is at rest. There turn pipe 223 is connected to the concentration adjustment tank 203 via a return valve 302. The supply tank 18, the supply nozzle 146, or any other desired location, to which the additive is to be supplied, may be selected depending on the type and properties of the polishing liquid used. If the polishing liquid used has a constant nature, then a permanently fixed piping system may be employed to supply the additive to one location.

The polishing liquid pipe 46 has a flow rate sensor 303 and a concentration sensor 305 and the additive supply pipe 222 has a flow rate sensor 304 for confirming whether the polishing liquid supply system is supplied with a predetermined quantity of the additive. Although the additive supply pipe 222 may have an additive concentration sensor, since it is usually difficult to measure an additive concentration from the additive alone, the typical property of the polishing liquid is detected by the concentration sensor 305 after the additive is added to the polishing liquid. The concentration sensor 305 comprises an ultrasonic concentration sensor, for example, and each of the flow rate sensors 303, 304 comprises an ultrasonic flow rate sensor, for example.

Output signals from the sensors 303, 304 and 305 are inputted into the controller 60. Based on the inputted signals, the controller 60 outputs control signals to control the concentration of the additive in the concentration adjustment tank 203 and the flow rate of the additive discharged from the additive supply pump 219 in a feedback control loop. Therefore, a polishing liquid having a constant additive concentration can be supplied to the polishing liquid supply system.

Operation of the polishing apparatus thus constructed will be described below.

The raw polishing liquid in the raw liquid tanks 14 is delivered to the adjustment tank 16 by the raw liquid pump 26. In the adjustment tank 16, the raw polishing liquid is diluted to a predetermined concentration with pure water that is supplied from the pure water line 24. The polishing liquid whose concentration has thus been adjusted is then delivered to the supply tank 18 by the liquid feed pump 30.

The polishing liquid stored in the supply tank 18 is caused to flow through the supply pipe 36 by the supply pump 34. When the polishing unit 12 is operated to polish a semiconductor wafer, the polishing liquid supply valve 48 is opened to supply the polishing liquid via the polishing liquid pipe 46 and the polishing liquid nozzle 146 onto the polishing surface of the turntable 142 in the polishing unit 12. When polishing of the semiconductor wafer is completed, the polishing liquid supply valve 48 is closed, and the circulation valve 50 is opened to circulate the polishing liquid through a circulation passage comprising the supply tank 18, the supply pipe 36, and the return pipe 37. Therefore, even when the polishing liquid is not supplied to the polishing unit 12, the polishing liquid is prevented from remaining stagnant in the pipes 36, 37 and 46, and hence abrasive particles in the polishing liquid are prevented from being deposited in these pipes 36, 37 and 46. The adjustment tank 16 is also associated with a similar circulation passage for returning the polishing liquid back to the adjustment tank 16 when the polishing liquid is not supplied to the supply tank 18.

The additive supply unit 200 is operated as follows: The raw material cartridge 201 is set to the upper portion of the constant rate feeder 202, and the hand-operated valve 204 is operated to open the bottom of the raw material cartridge 201 for thereby supplying the raw material powder of the additive into the hopper 205. The raw material powder is supplied through the hopper 205 into the constant rate feeder 202 where it is agitated and compacted to a constant density by the agitator 206 actuated by the motor 207. The motor 210 is energized to rotate the screw feeder 208 for thereby supplying the raw material powder via the powder supply pipe 209 into the concentration adjustment tank 203 at a given rate that is controlled by adjusting the rotational speed of the motor 210. The supplied quantity of the raw material powder can be confirmed by the weighing machine 211 disposed beneath the constant rate feeder 202.

The raw material powder is supplied into the concentration adjustment tank 203 through the opening 215 of the lid 217, and is uniformly mixed with the solvent supplied from the solvent supply pipe 212 by the agitator 218 in the concentration adjustment tank 203, thus preparing an additive having a predetermined concentration. The prepared additive is then supplied from the concentration adjustment tank 203 via the additive supply pipe 220 to the supply tank 18, for example, by the supply pump 219. The supplied quantity of the additive is adjusted based on the flow rate detected by the flow rate sensor 303 and the concentration detected by the concentration sensor 305 so that the concentration of the additive in the polishing liquid in the supply tank 18 is kept constant. If the additive used is susceptible to deterioration with age, then the additive should preferably be supplied directly to the polishing liquid nozzle 146 via the additive supply pipe 222. That is, the concentration adjustment tank 203 constitutes an additive tank for storing an additive having a predetermined concentration. The flow rate sensor 303, the concentration sensor 305, the controller 60 and the supply pump 219 constitute an additive quantity adjusting device for adjusting the quantity of the additive which is added to the polishing liquid.

The abrasive particle diameter distribution, the number of coarse particles, the oxidation-reduction potential, and the solid material concentration of the polishing liquid flowing through the supply pipe 36 are measured respectively by the abrasive particle diameter distribution measuring device 52, the coarse particle measuring device 54, the oxidation-reduction electrometer 56, and the solid material concentration measuring device 58. Measured data from these measuring devices 52, 54, 58 and the electrometer 56 are inputted into the controller 60 and monitored thereby. Based on the inputted measured data, the controller 60 determines whether the abrasive particle diameter distribution has changed or not and whether coarse particles have been produced or not. If the abrasive particle diameter distribution has changed, then the controller 60 outputs a control signal to actuate ultrasonic oscillators 94*a*, 94*b* attached to the respective tanks 16, 18.

The polishing liquid supply unit 10 combined with the additive supply unit 200 is capable of adding the additive such as an oxidizing agent to the polishing liquid while adjusting the quantity of the additive, in a downstream region close to the polishing unit 12. Therefore, the polishing liquid supply unit 10 can supply the polishing liquid that contains the additive of stable quality and concentration without deterioration or decomposition with age to the polishing unit 12. Thus, the semiconductor wafers can be polished stably in a desired quality.

Figure 4:
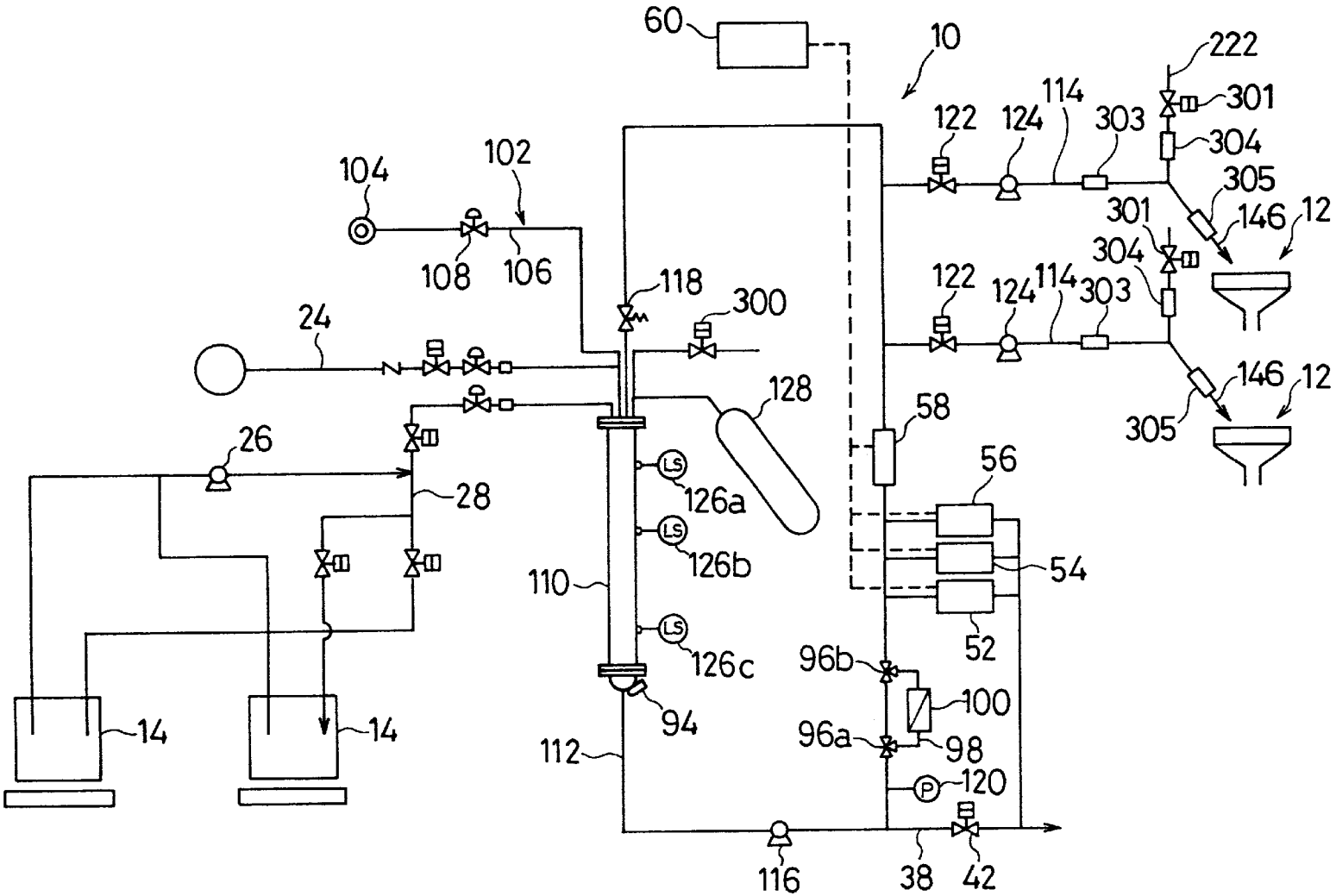
FIG. 4 is a schematic view of a polishing apparatus which incorporates a polishing liquid supply apparatus according to a second embodiment of the present invention.

FIG. 4 schematically shows a polishing apparatus which incorporates a polishing liquid supply apparatus according to a second embodiment of the present invention.

The polishing liquid supply unit 10 shown in FIG. 4 supplies a polishing liquid from a common source to a plurality of polishing units 12. Although two polishing units 12 are shown as being connected to the polishing liquid supply unit 10, more polishing units 12 may be connected to the polishing liquid supply unit 10. In FIG. 4, the polishing liquid supply unit 10 comprises a buffer tube 110 in the form of a cylindrical container, a circulation pipe 112 extending from the bottom of the buffer tube 110 through a region near the polishing units 12 back to the top of the buffer tube 110, and a plurality of discharge pipes 114 branched from the circulation pipe 112 to the respective polishing units 12.

The circulation pipe 112 has a circulation pump 116 for circulating a predetermined quantity of the polishing liquid at all times through the circulation pipe 112, a back pressure valve 118 for keeping the pressure in the circulation pipe 112 at a predetermined level or higher, and a pressure sensor 120 for detecting the pressure in the circulation pipe 112. Each of the discharge pipes 114 has a polishing liquid supply valve 122 and a discharge pump 124 for discharging the polishing liquid from the circulation pipe 112.

The buffer tube 110 serves as both the adjustment tank 16 and the supply tank 18 according to the first embodiment. A raw liquid pipe 28, a pure water line 24, and a chemical liquid supply line 106 are connected to the top of the buffer tube 110. The buffer tube 110 is associated with an ultrasonic oscillator 94 as a first polishing liquid property stabilizing means, a plurality of level detectors 126*a*, 126*b* and 126*c* for detecting the level of the polishing liquid in the buffer tube 110, and an air bag 128 made of an elastically expandable and contractible material. The air bag 128 serves to suppress changes in the pressure in the buffer tube 110 due to changes in the level of the polishing liquid in the buffer tube 110 while keeping the space in the buffer tube 110 hermetic against the atmosphere around the buffer tube 110.

In the embodiment shown in FIG. 4, an abrasive particle diameter distribution measuring device 52, a course particle measuring device 54, an oxidation-reduction electrometer 56, and a solid material concentration measuring device 58 are connected to the circulation pipe 112 at positions downstream of the circulation pump 116. The circulation pipe 112 is shunted by a bypass line 98, with a filter 100, which is connected to the circulation pipe 112 through valves 96*a*, 96*b*. An additive supply pipe from an additive supply unit is connected to the buffer tube 110 through a valve 300 or directly to each of the polishing liquid supply nozzles 146 through the additive supply pipe 222 and the valve 301. Various sensors are positioned in the same manner as with those of the first embodiment.

Figure 3:
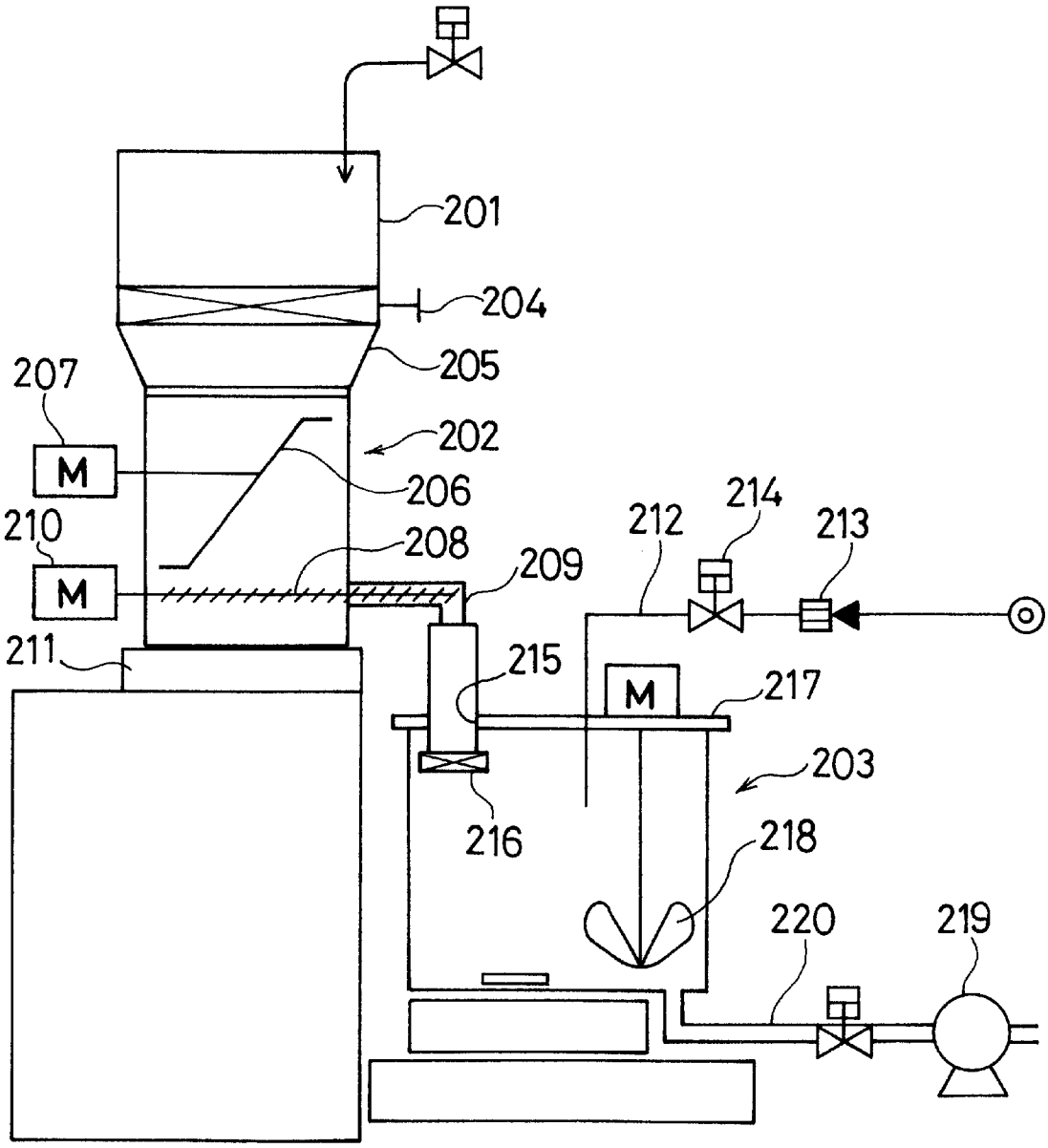
FIG. 3 is a schematic view of an additive supply unit of the polishing apparatus shown in FIG. 1.

The polishing apparatus shown in FIG. 4 is operated substantially in the same manner as the polishing apparatus shown in FIGS. 1 through 3. With the polishing liquid supply unit 10 shown in FIG. 4, since the polishing liquid is circulated at all times through the circulation pipe 112 from which the polishing liquid is supplied to the polishing unit 12, the circulation pipe 112 and associated pipes are prevented from being clogged due to changes in the concentration of the polishing liquid and deposits of the solid material of the polishing liquid which would otherwise occur if the polishing liquid remains stagnant. Since the circulation pipe 112 and associated pipes, which are free of unwanted clogging, can be increased in length, the polishing liquid can stably be supplied from the single buffer tube 110 to many polishing units 12. As a result, the cost of the polishing apparatus with the polishing liquid supply unit 10 can be lowered.

According to the present invention, the raw material powder of the additive is dissolved in the solvent immediately before the additive is used, and then the additive is supplied to the polishing liquid supply system. Therefore, the additive is prevented from being decomposed or deteriorated while the polishing liquid is held in storage for a long period of time. The additive can be supplied at a constant concentration and at a constant rate to the polishing table for achieving stable polishing capabilities. Thus, the polishing apparatus can perform good and stable polishing of semiconductor wafers.

Although certain preferred embodiments of the present invention have been shown and described in detail, it should be understood that various changes and modifications may be made therein without departing from the scope of the appended claims.

What is claimed is:

1. An apparatus for supplying a polishing liquid to a polishing unit for polishing a workpiece, comprising:

a supply tank for storing a polishing liquid having a predetermined concentration;

a polishing liquid pipe for delivering the polishing liquid from said supply tank to a polishing liquid supply nozzle in a polishing unit;

an additive tank for storing an additive having a predetermined concentration; and an additive supply pipe in direct fluid communication with said polishing liquid pipe for delivering the additive from said additive tank to the polishing liquid in a polishing liquid passage that includes said polishing liquid pipe.

2. The apparatus according to claim 1, further comprising an additive concentration adjusting device for adjusting the additive to its predetermined concentration.

3. The apparatus according to claim 2, wherein said additive concentration adjusting device includes an additive preparing device for mixing a raw material powder and a solvent to form the additive having the predetermined concentration.

4. An apparatus for supplying a polishing liquid to a polishing unit for polishing a workpiece, comprising:

a supply tank for storing a polishing liquid having a predetermined concentration;

a polishing liquid pipe for delivering the polishing liquid from said supply tank to a polishing liquid supply nozzle in a polishing unit;

an additive tank for storing an additive having a predetermined concentration;

an additive supply pipe for delivering the additive from said additive tank to the polishing liquid in said supply tank or to the polishing liquid in a polishing liquid passage that includes said polishing liquid pipe; and an additive quantity adjusting device provided in at least one of said additive tank and said additive supply pipe for adjusting the quantity of the additive that is to be added to the polishing liquid.

5. The apparatus according to claim 4, further comprising a sensor for detecting the concentration of the additive, and a controller for controlling said additive quantity adjusting device based on an output signal from said sensor.

6. An apparatus for supplying a polishing liquid to a polishing unit for polishing a workpiece, comprising:

a supply tank for storing a polishing liquid having a predetermined concentration;

a polishing liquid pipe for delivering the polishing liquid from said tank to a polishing liquid supply nozzle in a polishing unit;

an additive tank for storing an additive having a predetermined concentration;

an additive supply pipe for delivering the additive from said additive tank to the polishing liquid in said supply tank or to the polishing liquid in a polishing liquid passage that includes said polishing liquid pipe;

an additive concentration adjusting the additive to its predetermined concentration;

a sensor for detecting the concentration of the additive; and a controller for controlling the additive concentration adjusting device based on an output from said sensor.

7. A polishing apparatus for polishing a workpiece, comprising:

a polishing unit to polish a workpiece; and a polishing liquid supply apparatus to supply a polishing liquid to said polishing unit, said polishing liquid supply apparatus including (i) a supply tank for storing a polishing liquid having a predetermined concentration;

(ii) a polishing liquid pipe for delivering the polishing liquid from said supply tank to a polishing liquid supply nozzle in said polishing unit;

(iii) an additive tank for storing an additive having a predetermined concentration; and (iv) an additive supply pipe in direct fluid communication with said polishing liquid pipe for delivering the additive from said additive tanks to the polishing liquid in a polishing liquid passage that includes said polishing liquid pipe.

8. The polishing apparatus according to claim 7, wherein said polishing unit is to polish the workpiece by holding the workpiece with a workpiece holder and pressing the workpiece against a polishing surface on a polishing table.

9. The polishing apparatus according to claim 8, further comprising an additive concentration adjusting device for adjusting the additive to its predetermined concentration.

10. The polishing apparatus according to claim 9, wherein said additive concentration adjusting device includes an additive preparing device for mixing a raw material powder and a solvent to form the additive having the predetermined concentration.

11. A polishing apparatus for polishing a workpiece, comprising:

a polishing unit to polish a workpiece;

a polishing liquid supply apparatus to supply a polishing liquid to said polishing unit, said polishing liquid supply apparatus including (i) a supply tank for storing a polishing liquid having a predetermined concentration;

(ii) a polishing liquid pipe for delivering the polishing liquid from said supply tank to a polishing liquid supply nozzle in said polishing unit;

(iii) an additive tank for storing an additive having a predetermined concentration; and (iv) an additive supply pipe for delivering the additive from said additive tank to the polishing liquid in said supply tank or to the polishing liquid in a polishing liquid passage that includes said polishing liquid pipe; and an additive quantity adjusting device provided in at least one of said additive tank and said additive quantity adjusting device provided in at least one of said additive tank and said additive supply pipe for adjusting the quantity of the additive that is to be added to the polishing liquid.

12. The polishing apparatus according to claim 11, wherein said polishing unit is to polish the workpiece by holding the workpiece with a workpiece holder and pressing the workpiece against a polishing surface on a polishing table.

13. The polishing apparatus according to claim 12, further comprising a sensor for detecting the concentration of the additive, and a controller for controlling said additive quantity adjusting device based on an output signal from said sensor.

14. A polishing apparatus for polishing a workpiece, comprising:

a polishing unit to polish a workpiece;

a polishing liquid supply apparatus to supply a polishing liquid to said polishing unit, said polishing liquid supply apparatus including (i) a supply tank for storing a polishing liquid having a predetermined concentration;

(ii) a polishing liquid pipe for delivering the polishing liquid from said supply tank to a polishing liquid supply nozzle in said polishing unit;

(iii) an additive tank for storing an additive having a predetermined concentration; and (iv) an additive supply pipe for delivering the additive from said additive tank to the polishing liquid in said supply tank or to the polishing liquid in a polishing liquid passage that includes said polishing liquid pipe;

an additive concentration adjusting device for adjusting the additive to its predetermined concentration;

a sensor for detecting the concentration of the additive; and a controller for controlling the additive concentration adjusting device based on an output from said sensor.

15. The polishing apparatus according to claim 14, wherein said polishing unit is to polish the workpiece by holding the workpiece with a workpiece holder and pressing the workpiece against a polishing surface on a polishing table.

16. An apparatus for supplying a polishing liquid to a polishing unit for polishing a workpiece, comprising:

a supply tank for storing a polishing liquid having a predetermined concentration:

a polishing liquid pipe for delivering the polishing liquid from said supply tank to a polishing liquid supply nozzle in a polishing unit, wherein the polishing liquid to be delivered by said polishing liquid pipe is to be circulated through said polishing liquid pipe;

an additive tank for storing an additive having a predetermined concentration; and an additive supply pipe for delivering the additive from said additive tank to the polishing liquid in said supply tank or the polishing liquid in a polishing liquid passage that includes said polishing liquid pipe.

17. The apparatus according to claim 16, wherein said polishing liquid pipe includes a first portion in fluid communication with a discharge of said supply tank, a second portion in fluid communication with said first portion and the nozzle, and a third portion in fluid communication with said first portion and an inlet of said supply tank, such that when the polishing liquid is to be delivered from said supply tank to the nozzle the polishing liquid flows through said portion and said second portion, and when the polishing liquid is to be circulated through said polishing liquid pipe the polishing liquid flows through said first portion, said third portion and said supply tank.

18. A polishing apparatus for polishing a workpiece, comprising:

a polishing unit to polish a workpiece; and a polishing liquid supply apparatus to supply a polishing liquid to said polishing unit, said polishing liquid supply apparatus including (i) a supply tank for storing a polishing liquid having a predetermined concentration;

(ii) a polishing liquid pipe for delivering the polishing liquid from said supply tank to a polishing liquid supply nozzle in said polishing unit, wherein the polishing liquid to be delivered by liquid from said supply tank to said polishing liquid pipe is to be circulated through said polishing liquid pipe;

(iii) an additive tank for storing an additive having a predetermined concentration; and (iv) an additive supply pipe for delivering the additive from said additive tank to the polishing liquid in said supply tank or to the polishing liquid passage that includes said polishing liquid pipe.

19. The polishing apparatus according to claim 18, wherein said polishing unit is to polish the workpiece by holding the workpiece with a workpiece holder and pressing the workpiece against a polishing surface on a polishing table.

20. The polishing apparatus according to claim 19, wherein said polishing liquid pipe includes a first portion in fluid communication with a discharge of said supply tank, a second portion in fluid communication with said first portion and the nozzle, and a third portion in fluid communication with said first portion and an inlet of said supply tank, such that when the polishing liquid is to be delivered from said supply tank to the nozzle the polishing liquid flows through said first portion and said second portion, and when the polishing liquid is to be circulated through said polishing liquid pipe the polishing liquid flows through said first portion, said third portion and said supply tank.

21. The polishing apparatus according to claim 18, wherein said polishing liquid pipe includes a first portion in fluid communication with a discharge of said supply tank, a second portion in fluid communication with said first portion and the nozzle, and a third portion in fluid communication with said first portion and an inlet of said supply tank, such that when the polishing liquid is to be delivered from said supply tank to the nozzle the polishing liquid flows through said first portion and said second portion, and when the polishing liquid is to be circulated through said polishing liquid pipe the polishing liquid flows through said first portion, said third portion and said supply tank.

* * * * *

UNITED STATES PATENT AND TRADEMARK OFFICE

CERTIFICATE OF CORRECTION

PATENT NO. : 6,358,125 B2
DATED : March 19, 2002
INVENTOR(S) : Kiyotaka Kawashima et al.

It is certified that error appears in the above-identified patent and that said Letters Patent is hereby corrected as shown below:

Column 10,
Line 14, after “adjusting” insert -- device for adjusting --.

Column 11,
Lines 20-22, delete “quantity adjusting device provided in at least one of said additive tank and said additive”.

Column 12,
Line 9, after “through said” insert -- first --.
Lines 12-13, delete “liquid from said supply tank to”, and
Line 19, before “passage” insert -- in a polishing liquid --.

Signed and Sealed this

Sixteenth Day of July, 2002

*Attest:*

*Attesting Officer*

JAMES E. ROGAN
*Director of the United States Patent and Trademark Office*